United States Patent [19]

Barnes et al.

[11] Patent Number: 4,993,662

[45] Date of Patent: Feb. 19, 1991

[54] APPARATUS FOR GUIDING A MISSILE

[75] Inventors: Daniel C. Barnes; Wendell J. Bridges; Jon R. Carr, all of Indianapolis, Ind.

[73] Assignee: The United States of America as represented by the Secretary of the Navy, Washington, D.C.

[21] Appl. No.: 56,014

[22] Filed: Jul. 7, 1970

[51] Int. Cl.[5] ..... F41G 7/00

[52] U.S. Cl. ..... 244/3.17; 342/64

[58] Field of Search ..... 343/5; 244/3.17; 342/64

[56] References Cited

U.S. PATENT DOCUMENTS

| | | | |
|---|---|---|---|
| 2,814,199 | 11/1957 | Waldorf et al. | 244/3.17 |
| 3,071,765 | 1/1963 | Schutz | 244/3.17 |
| 3,226,058 | 12/1965 | Menely | 244/3.17 |

*Primary Examiner*—Brian S. Steinberger

*Attorney, Agent, or Firm*—Sol Sheinbein; John Becker; Harvey David

[57] ABSTRACT

A device for correcting the flight path of an air to surface missile and guiding said missile to a target. A first map of a strip of ground which is transverse to the direction of flight is provided on a rotatable drum along with a second map of a strip of ground which is parallel with the direction of flight. A live image of the ground over which said missile is traveling is projected first through the first map to provide a position fix of the missile in range and azimuth relative to a target and after a correction has been made to the flight path of the missile, the live image of the ground is projected through the second map to provide guidance correction to direct the missile to the target.

4 Claims, 3 Drawing Sheets

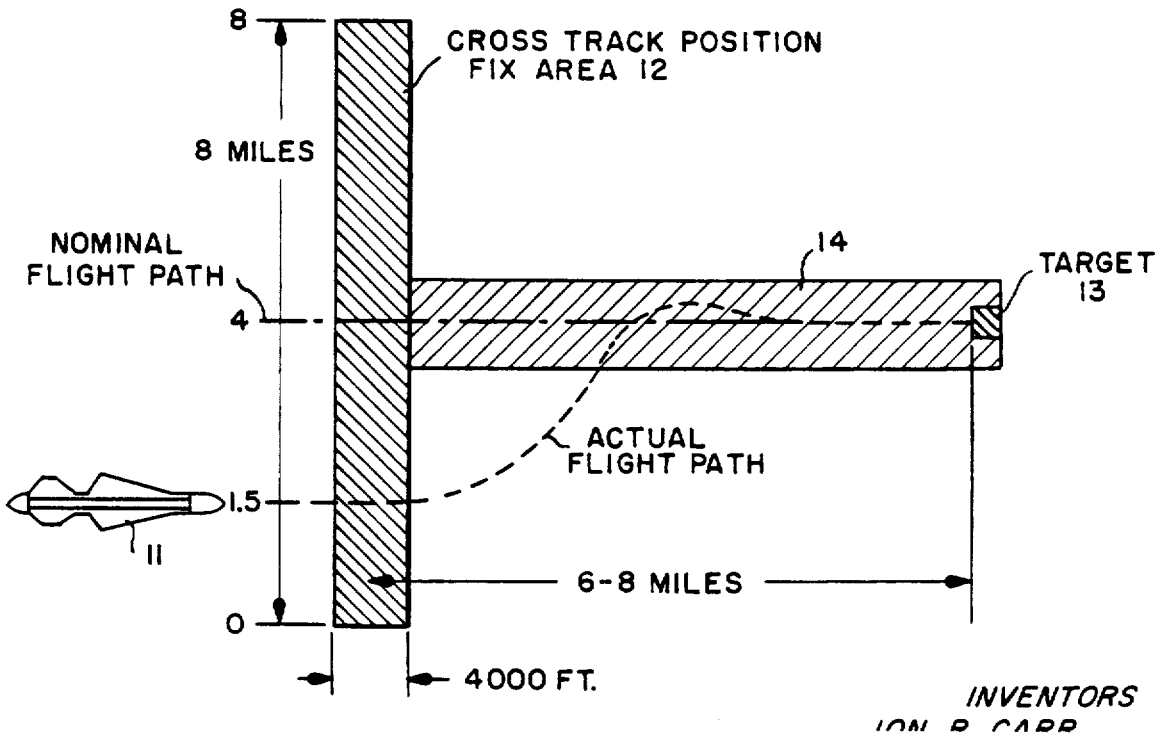
8
CROSS TRACK POSITION
FIX AREA 12
8 MILES
NOMINAL
FLIGHT PATH
14
TARGET
13
4
ACTUAL
FLIGHT PATH
1.5
11
6-8 MILES
0
4000 FT.
INVENTORS

APPARATUS FOR GUIDING A MISSILE

BACKGROUND OF THE INVENTION

The present invention relates to a navigation device and more particularly to a device for first establishing the position of a missile in range and cross-track coordinates relative to the position of a target and, after making a heading correction, to provide map guidance means for directing the missile to the target.

Many of the early air-to-ground missiles were carried by a plane to a target area for launching as these early types of missiles had no homing features. One of the main disadvantages of this method of firing missiles is that the delivering aircraft was subjected to continual gun fire as the aircraft entered or neared the target area. In order to relieve this danger to pilots and their aircraft, various devices and systems have been employed to provide automatic guidance so that a missile can home on a target.

One such guidance system is shown and described in U. S. Pat. No. 3,071,765, entitled, "Radar Map Guidance System", which issued Jan. 1, 1963, to Gerald C. Schutz. In this patent, a system is disclosed whereby a reconnaissance airplane is caused to leave a launching platform and separately from a forwardly directed antenna assembly and from a laterally directed radar assembly to make a time track and an azimuth track on preferably a single film that is continuously uninterrupted from the time the reconnaissance aircraft leaves its launching platform until it arrives at a proposed target. The system contemplates an equipment for making the flight record map in the reconnaissance plane and interpreting that record in a pilotless aircraft controlled in azimuth and in time by the two tracks on the film made in the pilotless aircraft for the purpose of causing the pilotless aircraft to duplicate the flight of the reconnaissance aircraft.

Another guidance system is shown and described in U. S. Pat. No. 3,163,377, entitled "Map Matching Navigation Control System For Aircraft", which issued Dec. 29, 1964, to Richard L. Burtner. This patent was concerned with indicating or controlling the flight path of aircraft over areas where large land-water boundaries exist. A radar display image is projected onto a negative contrast reference map of the terrain to be navigated, the map and image having substantially the same scale and orientation. Means is provided in the path of the projected image to effect nutational movement between the map and display image. Motor means associated with the map serves to move the map in a plane transversely of the light path of the projected display image. Photocell means in back of the map is responsive to the light passing through the map from the projected image source. An electronic polarity switch is associated with the radar means for periodically reversing the contrast of the radar image and a similar electronic switch periodically inverts the output of the signal of the photocell means. Pulse-generating means, actuated periodically by the nutating means, simultaneously triggers the electronic switches so that the polarity of the output signal of the photocell means is inverted simultaneously with the reversing of the contrast of the radar display image. Means responsive to the output signal of the photocell means and associated electronic switch controls the motor means for maintaining alignment between the radar display image and the reference map.

In U. S. patent application Ser. No. 752,730, entitled, "An Apparatus For Establishing An In-Flight Position Of A Missile" which was filed Aug. 6, 1968, by Paul L. Brink, Jack L. Loser, and David M. Stutsman, there is disclosed a film drum scanner having a strip map attached to a drum which is rotatable at a constant angular velocity. The map is of a strip of land which is transverse to the direction of flight and over which a missile will fly on its flight to a target. When the missile passes over the ground which has previously been photographed, a lens system views or "sees" an area of ground, the image of which is projected through the end strip map to a photomultiplier detector. When the positive image of the ground scene comes into registration with the negative replica on the drum, a sharp decrease in the amount of light is passed through to the photo-multiplier detector. This signal is filtered and detected. By indexing the beginning of the replica and noting the position of the correlation function with respect to the indexing signal, the cross-track position of the missile at a known down-range position can be determined. When a fix position is made, a signal can be sent to an autopilot to correct the flight path of the missile so that the missile will be directed to its nominal flight path.

SUMMARY OF THE INVENTION

In the present invention, a film drum scanner is provided that has a first strip map of land transverse to the flight path of a missile and a second strip map of land parallel with the flight path. The second strip map is of land between a target and the strip of land depicted on the first strip map. A lens system is provided which views or "sees" an area of ground, the image of which is projected through the first strip map to a photo-multiplier detector. When the positive image of the ground scene comes into registration with the negative replica of the first strip of land, a sharp decrease in the amount of light is passed through to the photo-multiplier detector. This signal is filtered and detected. By indexing the beginning of the replica and noting the position of the correlation function with respect to the indexing signal, the cross-track position of the missile at a known down-range position can be determined.

A midcourse maneuver of the missile is performed based on the cross-track position and missile heading at the time the missile crosses the land depicted on the first strip map. The missile is given a heading of 5 degrees with respect to the nominal flight path to insure that the missile will cross the strip of land depicted on the second strip map. After the missile passes over the strip of land depicted on the first strip map, the direction of scan is rotated ninety degrees so that the direction of scan is along the nominal flight path rather than normal to it. The ground scene image is then rerouted to pass through the second strip map and correlation is used to determine missile displacement from the nominal flight path and this displacement is used as an error signal for the missile autopilot which steers the missile onto the nominal flight path.

BRIEF DESCRIPTION OF THE DRAWINGS

FIG. 1 is a diagrammatic view showing a prior art arrangement for making correction in the flight path of an air-to-surface missile;

FIG. 2 is a diagrammatic view showing an arrangement of the present invention for making correction in the flight path of an air-to-surface missile;

DESCRIPTION OF THE PREFERRED EMBODIMENT

Figure 3:
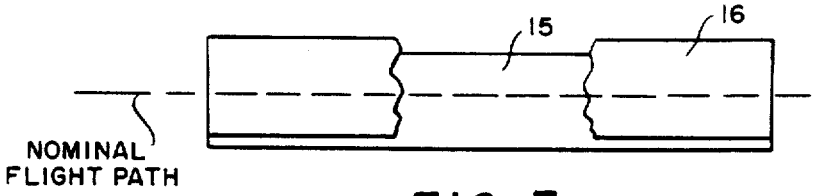
FIG. 3 is a diagrammatic view showing a terminal guidance arrangement having two reference strips.

Referring first to FIG. 1 of the drawings, there is shown a flight path correction scheme of the prior art. An air-to-surface missile 11 will pass over an end strip 12 and a photographic representation of end strip 12 is utilized to establish the air-to-surface missile's position both in cross-track and range. The range position fix is determined by a prior knowledge of the distance from the end strip 12 to a target 13, and the cross-track position is determined by measuring the position of that portion of end strip 12 where correlation occurs with a live ground image. The correlator for determining cross-track position is described in U. S. Patent Application entitled, "Apparatus For Establishing An In-Flight Postion Of A Missile", Ser. No. 752,730, filed Aug. 6, 1968, by Paul L. Brink, Jack L. Loser, and David M. Stutsman.

Referring now to FIG. 2 of the drawing, there is shown another method of correcting the flight path of an air-to-surface missile 11 in which a midcourse maneuver is first performed to head the missile onto a desired flight path and then means are provided for terminal guidance of the missile 11 to the target. A cross-track position fix area 12 is used to make the midcourse correction and a terminal fix area 14 is provided to direct the air to surface missile 11 to target 13.

Figure 8:
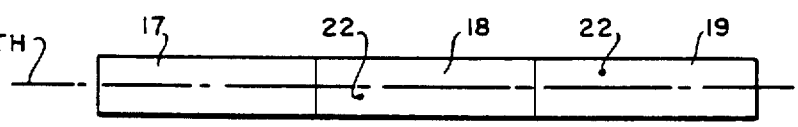
FIG. 8 shows an arrangement of film strips prior to fastening around a film drum.
Figure 5:
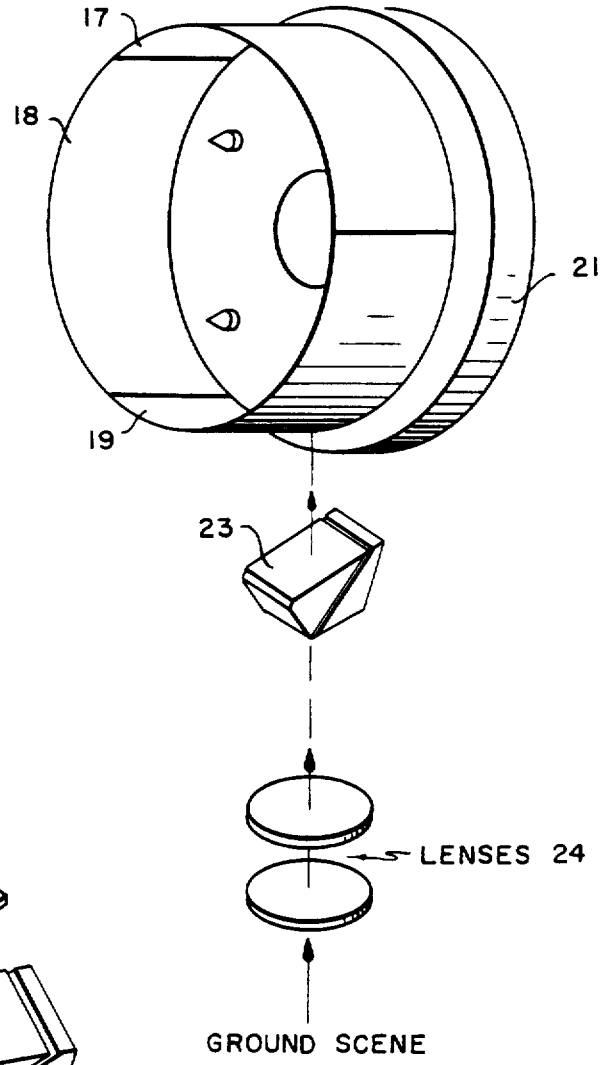
FIG. 5 is a diagrammatic view showing a film drum scanner with a lens and prism arrangement.

As shown in FIG. 3 of the drawings, terminal fix area 14 preferably contains two reference scenes 15 and 16 which are located along the nominal flight path. Reference scene 15 is offset to one side of the nominal flight path by approximately 50 feet and reference scene 16 is offset to the opposite side of the nominal flight path by approximately 50 feet. Film strips 17, 18, and 19 which depict cross-track area 12, reference scene 15, and reference scene 16, respectively, are fastened end to end, as shown in FIG. 8 of the drawings and are then fastened to a drum 21, as shown in FIG. 5 of the drawings. As shown in FIG. 8 of the drawings, film strip 18 and film strip 19 both depict the terminal fix area 14, with point 22 on film strip 18 being on the right side of the nominal flight path and the same point 22 on film strip 19 is on the left side of the nominal flight path.

Figure 6A:
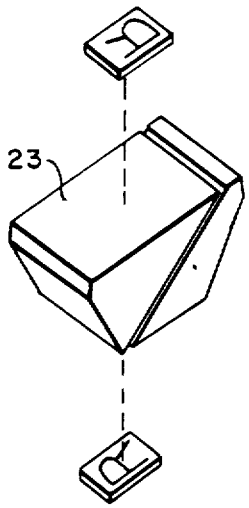
FIGS. 6(*a*) and 6(*b*) are diagrammatic views illustrating a prism arrangement for rotating a ground scene image.
Figure 6B:
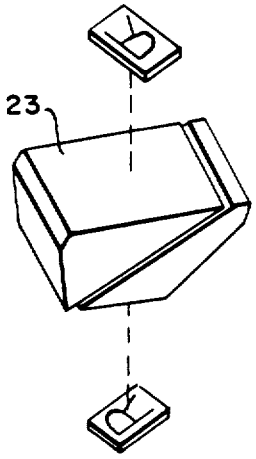

By way of example, drum 21 might be housed and rotated as shown and described in the above-referenced patent application to Brink et al. While missile 11 is crossing area 12, the position and the direction of rotation of drum 11 is such that the direction of scan is normal to the nominal flight path. After correlation is obtained as described in the referenced patent application to Brink et al, the direction of scan must be rotated 90 degrees so that the direction of scan is along the nominal flight path rather than normal to it. This can be accomplished by physically rotating film drum 21, or the housing in which film drum 21 is housed, or optical means may be provided to rotate, by 90 degrees, the image from the ground. In FIG. 5 of the drawing, a Pechan prism 23 is provided to perform this function of rotation of the image of the ground scene. As illustrated in FIGS. 6(*a*) and 6(*b*) of the drawings, a 45 degree rotation of Pechan prism 23 provides a 90 degree rotation of an image passing through the prism. Pechan prisms are more fully described on page 307 of the text, "Applied Optics and Optical Engineering" Volume II, Academic Press 1965.

Figure 4:
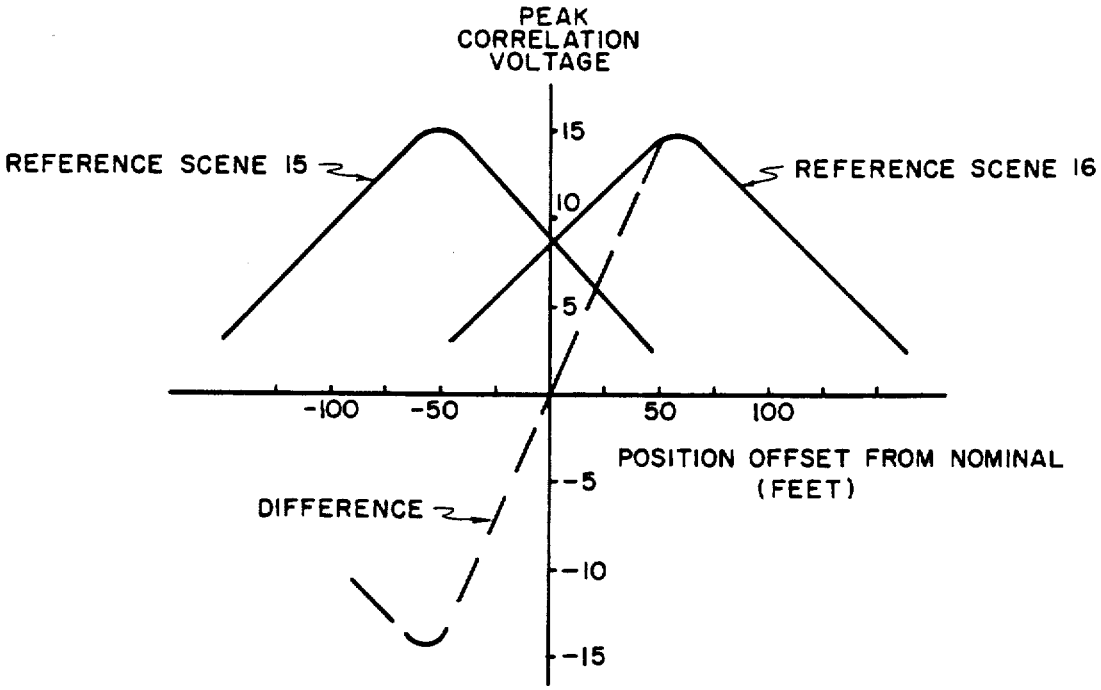
FIG. 4 is a graphical representation showing a discriminator curve and two correlation peak voltages for missile displacement from a pre-selected flight line.

As missile 11 passes over the nominal flight path, after making the midcourse correction, correlation peaks will be at maximum when missile 11 passes over both reference scenes 15 and 16. FIG. 4 of the drawings shows how the correlation peaks will change with missile position. Measuring the correlation peak voltages for reference scenes 15 and 16 and subtracting the output for reference scene 15 from the output for reference scene 16 gives a voltage which is proportional to the missile displacement from the nominal flight path. The output of a discriminator circuit is a linear measure of the missile offset distance from the nominal flight path and is used as an error signal for the missile autopilot which steers missile 11 onto the nominal flight path.

Figure 7:
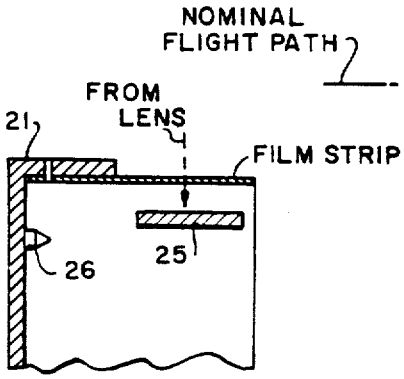
FIG. 7 is a partial sectional view showing a film drum and detector arrangement.

As best shown in FIGS. 5 and 7 of the drawings, a ground scene image is obtained by means of lenses 24, and this ground scene image is of a vertical view of the ground below and is passed through prism 23, and the film strips 17, 18, and 19, during rotation of drum 21. A detector 25 is provided to receive the ground scene image after it passes through the film strips and the output from detector 25 is applied to appropriate discriminator circuitry. Detector 5 is more fully described in the above-referenced U. S. Patent application, entitled, "Correlation Homing Guidance Device".

OPERATION

In planning a mission for the destruction of a target 13, an area 12 approximately 8 miles in width and 4,000 feet in depth is photographed, as by a high altitude, high speed, reconnaissance plane. Area 12 is at a known fixed distance from target 13, such as between 6 and 8 miles. Also an area 14 which is about 4,000 feet in width and which extends from area 12 to target 13 is photographed and film strips of areas 12 and 14 are made and attached to a rotatable drum 21. Preferably two film strips of area 14 are made and one of these is offset about 50 feet to the left of a nominal flight path and the other film strip is offset about 50 feet to the right of a nominal flight path.

In a typical flight mission, missile 11 might be launched at an altitude of 40,000 feet at a distance of about 100 miles from target 13. At this altitude and distance from target 13, the launching aircraft could be relatively secure from counterattack and, after missile launch, the launching aircraft can return to its base.

After the air-to-surface missile 11 is launched, it can proceed under its own power at a high altitude toward previously selected target 13 with guidance being provided by a medium quality autopilot, which is well-known in the prior art. At the conclusion of the air-to-surface missile's initial burn phase, missile 11 begins a pre-programmed descent and then levels off at a low altitude of about 2,000 feet at a nominal range of 15 to 20 miles from target 13. A low altitude run-in is made because of the concern for cloud coverage.

It is recognized that the position of missile 11 will involve uncertainties due largely to errors in launch position, uncompensated wind, and drift in the missile autopilot. As shown in FIG. 2 of the drawings, missile 11 will pass over area 12 on its flight to target 13 and a "live" scene is correlated with transparency 17 to establish the missile's position both in cross-track and in range. The range position fix is determined by knowing the distance from area 12 to target 13, and the cross-track position is determined by measuring the position of that portion of area 12 where correlation had occurred with respect to the beginning of transparency which is indicated by a signal from magnetic pickoff 26.

The "live" input scene, which might be a circle with a diameter equal to the depth of area 12, that is, 4,000 feet, is obtained from a vertical view and focused by lens system 24 on transparency 17. As missile 11 crosses area 12, the angular velocity of drum 21 produces a scanning of transparency 17 across the "live" input ground scene. Since transparency 17 is a negative image and the "live" scene represents a positive image, then there is a sharp decrease in the amount of light which passes through transparency 17 when the two images coincide or correlate. This is due to a cancellation of the white and black areas on transparency 17 with corresponding black and white areas in the "live" input scene.

The light which passes through transparency 17 is sensed by detector 25 from which an electrical signal is obtained. This electrical signal is proportional to the amount of light striking detector 25 and represents the degree of match between the "live" ground scene and transparency 17 and, as more fully described in the above-referenced patent application of Brink et al, the electrical signal is processed to make a correction in the flight path of missile 11. As shown in FIG. 2 of the drawings, in the event that missile 11 is to the right of the nominal flight path, missile 11 will be directed to make a left turn and, consequently, missile 11 will be heading so that it will fly over area 14.

After correlation is made between the "live" scene and transparency 17, prism 23 is rotated 45 degrees and, as illustrated in FIGS. 6(*a*) and 6(*b*) of the drawings, the ground image will be rotated 90 degrees. Thus film strips 18 and 19, which are also on film drum 21, can now correlate with the "live" ground image from area 14.

When missile 11 enters over area 14, there is correlation with either reference scene 15 or reference scene 16 depending on the direction of approach. FIG. 4 of the drawings shows how the correlation voltage from either reference scene 15 or reference scene 16 varies with missile position. When the correlation voltage from either reference scene 15 or reference scene 16 reaches a maximum, missile 11 can be commanded to begin a maneuver onto the flight line. As missile 11 turns, a correlation voltage will begin to be obtained from the second reference scene. During the remaining portion of the flight, the correlation peak voltages for both reference scenes 15 and 16 will be sampled and differenced in a discriminator. The difference between the peak voltages is proportional to the displacement of missile 11 from the pre-selected flight line. The dashed line of FIG. 4 of the drawings shows a discriminator curve obtained by subtracting the two correlation peak voltages for any given missile displacement from the pre-selected flight line. The output of a discriminator can thus be used as an error signal to steer missile 11 onto the pre-selected flight line and to correct for any error in the initial indicated autopilot heading.

We claim:

1. A device for guiding a pilotless aircraft to a previously selected target comprising, a rotatable drum, a film strip attached to said drum having a first negative portion of a photographic representation of a first rectangular area of ground having its longitudinal axis normal to the nominal flight path for said pilotless aircraft, said first area of ground being a known distance from said target to be used for establishing a position fix for a pilotless aircraft with respect to a nominal flight path for said pilotless aircraft, and said film strip having a second negative portion of a photographic representation of a second rectangular area of ground having its longitudinal axis parallel with the nominal flight path for said pilotless aircraft, said second area of ground extending from said first area of ground to a previously selected target to be used for guiding a pilotless aircraft on he terminal portion of flight to a previously selected target, a lens system for superimposing a live view of the ground below said pilotless aircraft onto said film strip for correlating said live view of the ground below with the first area of ground depicted on said first negative portion of said film strip, and a Pechan prism spaced between said lens system and said film strip for rotating the image from said lens system when said live view of the ground below is to be correlated with the photographic representation on said second negative portion of said film strip.

2. A device for guiding a pilotless aircraft to a previously selected target as set forth in claim 1 having indexing means attached to said rotatable drum for indicating the beginnings of said first and second negative portions of photographic representations.

3. A device for guiding a pilotless aircraft to a previously selected target as set forth in claim 1 having means for determining the amount of light passing through said film strip when said live view of the ground is superimposed onto said film strip.

4. A device for guiding a pilotless aircraft to a previously selected target as set forth in claim 1 wherein said second negative portion of a photographic representation consists of first and second identical reference scenes, with said reference scenes being offset in width from one another.

* * * * *